US011338989B2

(12) United States Patent
Li

(10) Patent No.: US 11,338,989 B2
(45) Date of Patent: May 24, 2022

(54) DISPENSING CONTAINER

(71) Applicant: Oxygen Confectionery Corp., Wilmington, DE (US)

(72) Inventor: Yang Li, Mississauga (CA)

(73) Assignee: Oxygen Confectionery Corp., Wilmington, DE (US)

( * ) Notice: Subject to any disclaimer, the term of this patent is extended or adjusted under 35 U.S.C. 154(b) by 0 days.

(21) Appl. No.: 16/385,877

(22) Filed: Apr. 16, 2019

(65) Prior Publication Data

US 2019/0337708 A1 Nov. 7, 2019

Related U.S. Application Data

(63) Continuation of application No. 14/424,637, filed as application No. PCT/CN2012/080892 on Sep. 1, 2012, now Pat. No. 10,351,333.

(51) Int. Cl.
*B65D 83/04* (2006.01)
*B65D 85/60* (2006.01)

(52) U.S. Cl.
CPC ..... *B65D 83/0409* (2013.01); *B65D 85/60* (2013.01); *B65D 2583/0472* (2013.01)

(58) Field of Classification Search
CPC ..... A61J 1/03; B65D 83/0427; B65D 83/04; B65D 85/60; B65D 2583/0481; B65D 2583/0472
See application file for complete search history.

(56) References Cited

U.S. PATENT DOCUMENTS 2,039,282 A * 5/1936 Burke ..... G07F 11/44 221/197
2,341,447 A * 2/1944 Klotz ..... B65D 83/0409 221/256
2,669,349 A * 2/1954 Silver ..... B65D 83/0409 221/202
3,301,437 A * 1/1967 Faber ..... B65D 83/0409 221/202
3,310,201 A * 3/1967 Guarr ..... B65D 83/0409 221/197
3,319,827 A * 5/1967 Englesson ..... B65D 83/04 221/299

(Continued)

FOREIGN PATENT DOCUMENTS

FR 2928356 * 9/2011

*Primary Examiner* — Gene O Crawford
*Assistant Examiner* — Kelvin L Randall, Jr.
(74) *Attorney, Agent, or Firm* — Banner & Witcoff, Ltd.

(57) ABSTRACT

A novel chewing gum box includes a gum storage chamber, a storage chamber cover, a funnel apparatus, a gum introducing plate, a gum carrying groove, a carrying groove baffle, a push handle, a spring baffle, guide rails, guide rail grooves, a spring groove, and a spring. The gum storage chamber is communicated with the gum carrying groove through the funnel apparatus. The gum carrying groove is connected to the push handle and is capable of reciprocating along the guide rails and the guide rail groove. When retrieving gum, the box body is tilted and shaken first to allow gum in the storage chamber to slide along the gum introducing plate into the gum carrying groove via the funnel apparatus. The push handle then is actuated to have the gum pushed out along the guide rail and the guide rail groove, so that the gum is available for retrieval.

24 Claims, 5 Drawing Sheets

(56) References Cited

U.S. PATENT DOCUMENTS 3,362,583 A * 1/1968 Showalter ..... B65D 83/0409 221/298
3,610,466 A * 10/1971 Raybois ..... B65D 83/0409 221/135
3,788,517 A * 1/1974 Eannarino ..... B65D 83/0409 221/154
3,828,972 A * 8/1974 Bender ..... A61J 7/04 221/197
4,557,690 A * 12/1985 Randin ..... A61C 19/00 221/288
5,174,471 A * 12/1992 Kozlowski ..... B65D 83/0409 221/154
5,205,424 A * 4/1993 Gaspar ..... B65D 50/067 215/210
5,482,183 A * 1/1996 Beal ..... A61J 7/0076 221/150 A
5,553,739 A * 9/1996 Plum ..... B65D 83/0409 221/196
D489,003 S * 4/2004 Loth ..... D9/422
6,763,971 B1 * 7/2004 Tong ..... G07F 11/44 221/151
6,976,576 B2 * 12/2005 Intini ..... A45C 13/18 206/1.5
7,360,669 B2 * 4/2008 Drajan ..... B65D 83/0409 221/208
2003/0159965 A1 * 8/2003 Baker ..... B65D 47/0861 206/540
2004/0124204 A1 * 7/2004 Giraud ..... B65D 83/0409 221/263
2005/0205598 A1 * 9/2005 Gelardi ..... B65D 83/0409 221/263
2007/0000938 A1 * 1/2007 Renaud ..... B65D 83/04 221/263
2007/0114239 A1 * 5/2007 Smith ..... B65D 83/0409 221/263
2008/0011773 A1 * 1/2008 Tobias ..... B65D 83/0409 221/264
2008/0290110 A1 * 11/2008 Gelardi ..... B65D 83/0409 221/266
2013/0008918 A1 * 1/2013 Cronin ..... B65D 83/0409 221/174

* cited by examiner

[Fig. 1]
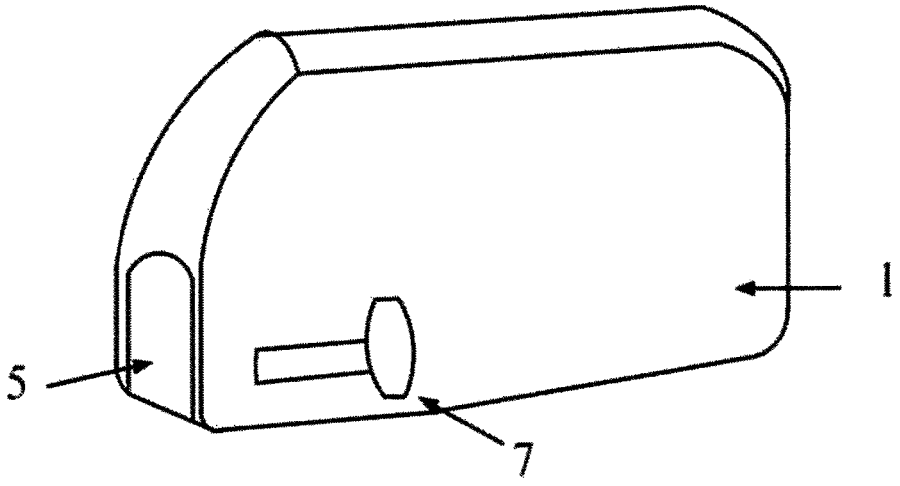
[Fig. 2]
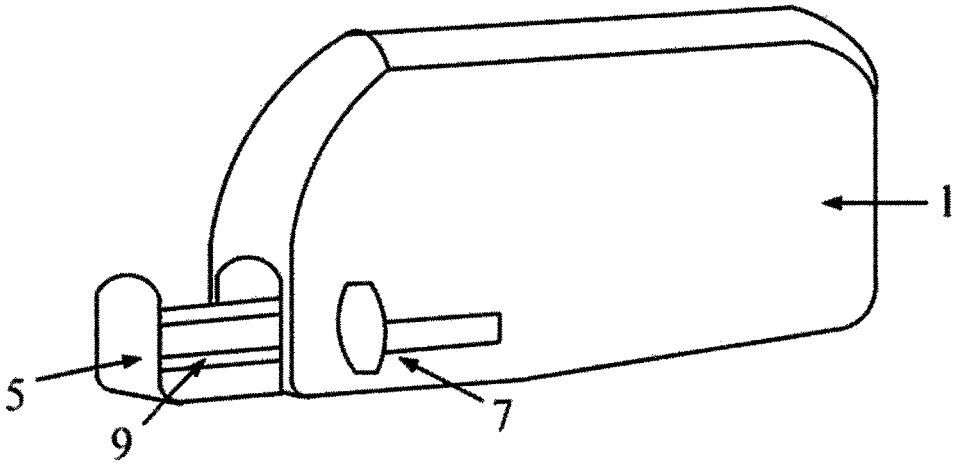

[Fig. 3]
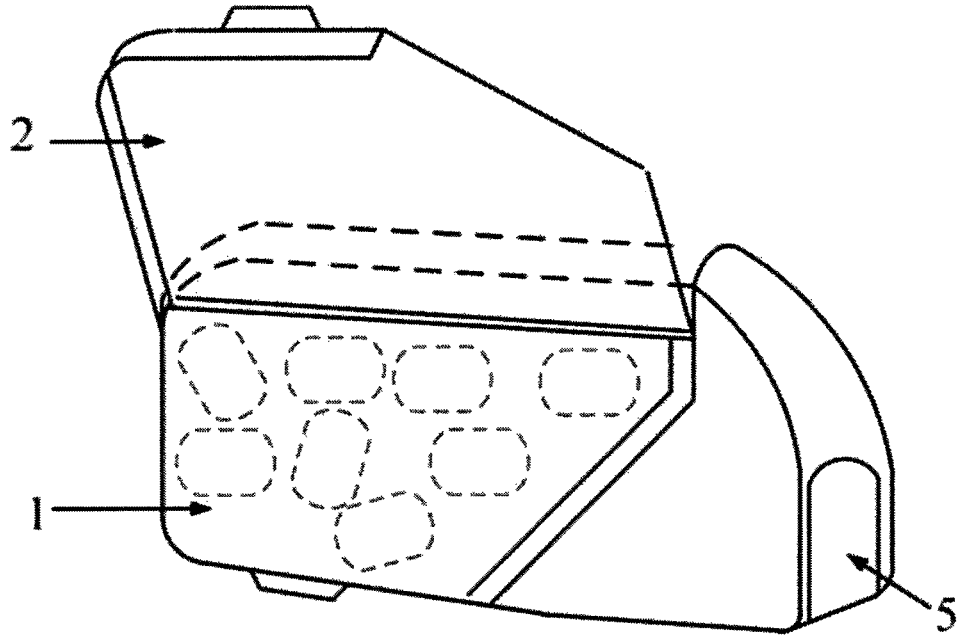
[Fig. 4]
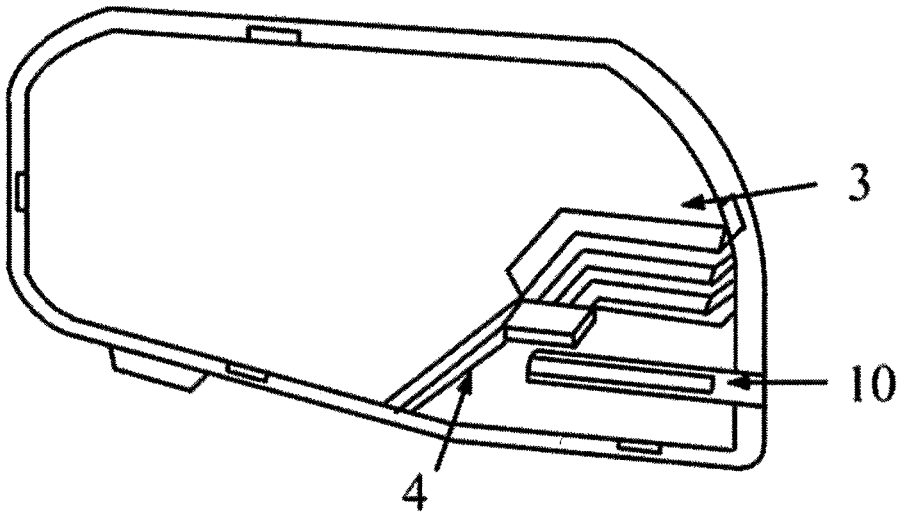

[Fig. 5]
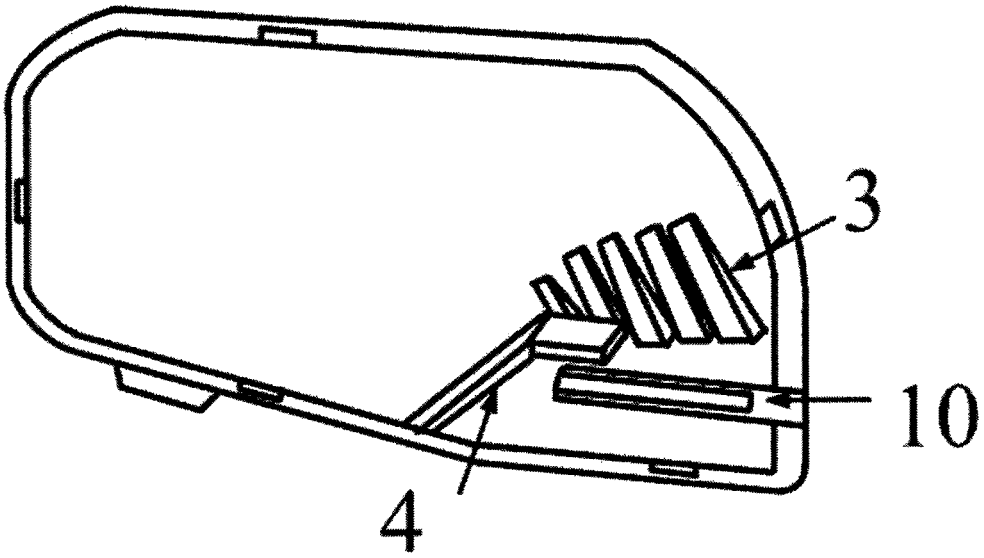
[Fig. 6]
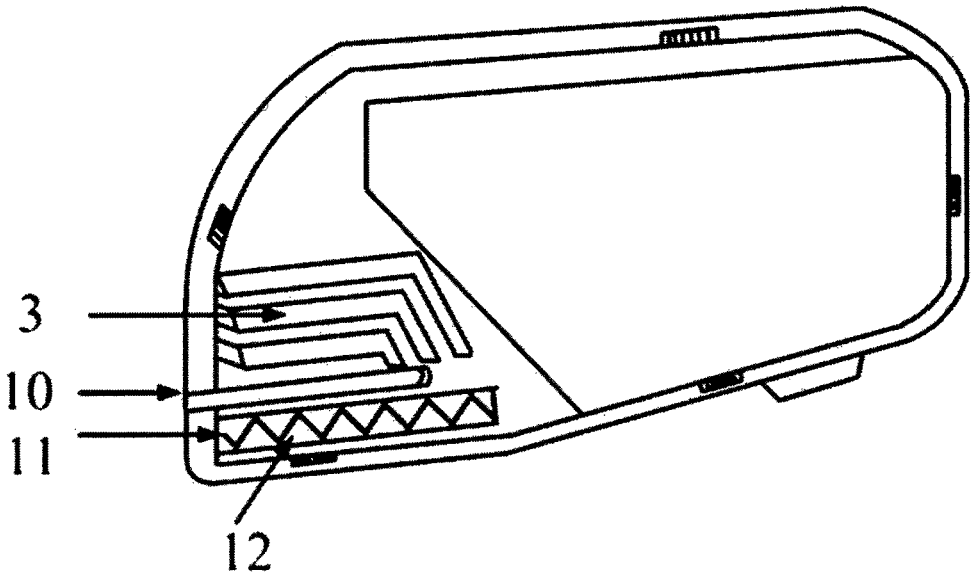

[Fig. 7]
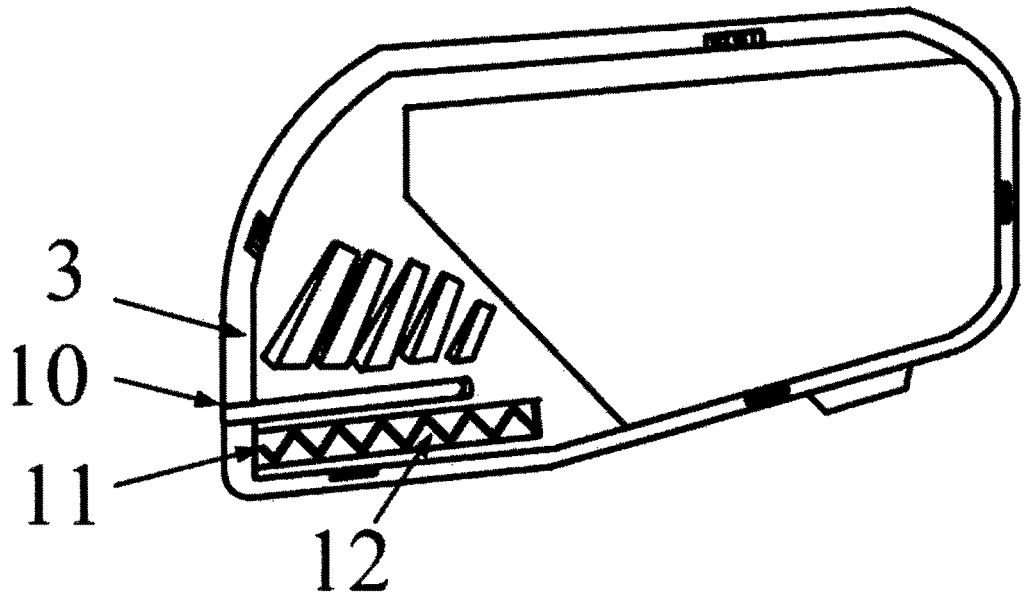
[Fig. 8]
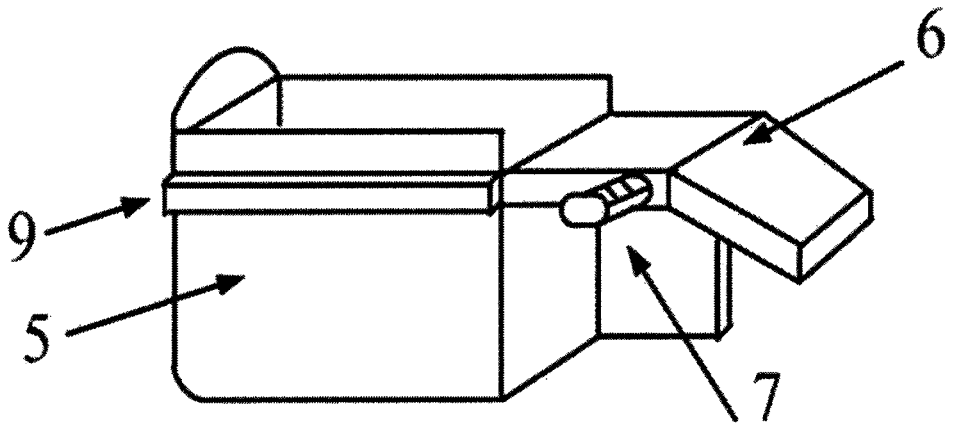

[Fig. 9]
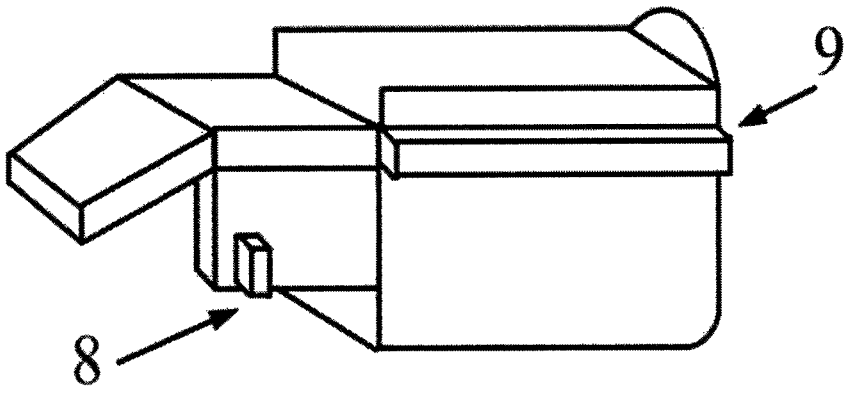

DISPENSING CONTAINER

CROSS-REFERENCE TO RELATED APPLICATIONS

This application is a continuation of U.S. patent application Ser. No. 14/424,637, filed Dec. 18, 2015, and issued as U.S. Pat. No. 10,351,333 on Jul. 16, 2019, which is a U.S. national stage application of International Application No. PCT/CN2012/080892, filed Sep. 1, 2012, both of which prior applications are incorporated by reference herein in their entireties.

TECHNICAL FIELD

The invention relates to the field of daily use manufacturing technology, particularly to a novel dispensing container such as a chewing gum box.

BACKGROUND

Chewing gum is a common consumer product, used for cleaning teeth to prevent oral cavities, protecting teeth, lowering stress and facilitating facial beauty. Most chewing gum packaging, while designed simply yet, produces several undesirable disadvantages. For example, in many cases, it is difficult to control the dispensing of the packaging contents. Thus, when trying to take a piece of chewing gum, multiple pieces may be poured out into the user's hands. In addition to being inconvenient, such practice also may by unhygienic, as the user may have to handle the unwanted pieces to put them back in the packaging. Additionally, much packaging of this type is not designed to be reusable, resulting in resource waste.

BRIEF SUMMARY

The invention aims to provide a novel chewing gum box for solving the abovementioned deficiencies.

In one aspect, a novel chewing gum box may include the following components: a chewing gum storage chamber, a storage chamber cover, a funnel apparatus, a chewing gum introducing plate, a chewing gum carrying groove or holder, a carrying groove baffle, a push handle, a spring baffle, guide rails, guide rail grooves, a spring groove and a spring. The chewing gum storage chamber is communicated with the chewing gum carrying groove through the funnel apparatus. The chewing gum carrying groove is connected with the push handle and is capable of performing reciprocating motion along the guide rails and the guide rail grooves between a stored position located within the housing and a dispensing position located external to the housing. The funnel apparatus is composed of a plurality of transverse or obliquely vertical or sloped bodies of increasing thickness that are arranged on the two sides of the inside of the box. The funnel apparatus also is disposed above and transversely in-line with the groove. The chewing gum introducing plate is connected with the funnel apparatus. Additionally or alternatively, the chewing gum introducing plate extends between and perpendicular to the storage chamber sides and is further configured to separate the chewing gum storage chamber and the chewing gum carrying groove. The size and shape of the chewing gum carrying groove is suitable for accommodating one or several pieces of chewing gum. Guide rails are arranged on the two sides of the chewing gum carrying groove, and the inner side of the box is provided with the guide rail groove. The rear part of the chewing gum carrying groove is connected with the carrying groove baffle. The spring baffle is arranged on one side of the chewing gum carrying groove. One side of the box is internally provided with the spring groove, and the spring is installed therein, such that one end of the spring is coupled to the chewing gum carrying groove and the opposite end of the spring is coupled to the box. Interactions are performed between the spring and the spring baffle on the side of the spring groove, such that the spring is configured to return the chewing gum carrying groove from a dispensing position to a stored position.

Compared with existing technologies, the invention has the beneficial effects of simple structure, convenient use, environmental friendliness and health.

BRIEF DESCRIPTION OF THE FIGURES

The following contents will further illustrate the invention by integrating figures and embodiments:

FIG. 1 is an isometric view of the solid diagram of the chewing gum box with a gum carrying groove in a retracted position.

FIG. 2 is an isometric view of the chewing gum box of FIG. 1 when the chewing gum carrying groove is pushed out.

FIG. 3 is an isometric view of the reverse side of the chewing gum box of FIG. 1 with the storage chamber cover in an open position.

FIG. 4 is an isometric isolated view of a chewing gum box showing the inner side of a left-half part of the chewing gum box and showing a hopper.

FIG. 5 is an isometric isolated view of another embodiment of a chewing gum box showing the inner side of the left-half part of the chewing gum box and showing another hopper.

FIG. 6 is an isometric isolated view of the chewing gum box of FIG. 4 showing the inner side of the right-half part of the chewing gum box and showing a hopper.

FIG. 7 is an isometric isolated view of the chewing gum box of FIG. 5 showing the inner side of the right-half part of the chewing gum box and showing another hopper.

FIG. 8 is an isometric isolated view showing the left side of the chewing gum carrying groove.

FIG. 9 is an isometric isolated view showing the right side of the chewing gum carrying groove.

The definitions of numbers in the figures: 1. chewing gum storage chamber, 2. storage chamber cover, 3. funnel apparatus, 4. chewing gum introducing plate, 5. chewing gum carrying groove or holder, 6. carrying groove baffle, 7. push handle, 8. spring baffle, 9. guide rail, 10. guide rail groove, 11. spring groove, 12. spring.

DETAILED DESCRIPTION

The chewing gum box is mainly composed of a chewing gum storage chamber 1, a storage chamber cover 2, a funnel apparatus 3, a chewing gum introducing plate 4 adjacent the funnel apparatus 3, the introducing plate 4 dividing the box into an upper chamber and a lower chamber, the upper chamber defining the storage chamber 1, a chewing gum carrying groove or holder 5, a carrying groove baffle 6, a push handle 7, a spring baffle 8, guide rails 9, guide rail grooves 10, a spring groove 11 and a spring 12.

In order to dispense chewing gum, a user may obliquely shake the box body to transfer chewing gum in the chewing gum storage chamber 1 into the chewing gum carrying groove or holder 5, e.g., by causing the gum to slide along the chewing gum introducing plate 4 via the funnel apparatus 3. The chewing gum carrying groove 5 may include a plurality of parallel sidewalls and a base extending between and joining those sidewalls, where both the sidewalls and the base extend parallel to a direction of motion of the gum carrying groove 5. As such, the sidewalls and base may form a cavity or bucket for receiving and confining the gum to be dispensed as and after the carrying groove 5 is moved into a pushed out or dispensing position. The user then may push the push handle 7 to have the chewing gum in the chewing gum carrying groove 5 be pushed out along the guide rail 9 and the guide rail groove 10. The push handle 7 translates along a groove that extends completely through one of the sides of the box. Once the gum carrying groove 5 is in the pushed out or dispensing position, the user then may take out the chewing gum from the groove 5.

The carrying groove baffle 6 is movable with the chewing gum carrying groove 5 and is configured to prevent chewing gum from falling into the gap that is formed during the course of pushing out the chewing gum carrying groove 5. The carrying groove baffle 6 also is configured to nest with the chewing gum introducing plate 4 when the groove is not pushed out. Additionally, once the chewing gum carrying groove is pushed out, the user can loosen the push handle 7 so that the chewing gum carrying groove 5 can return to the inside of the box body under the effect of the spring 12. Moreover, the dispenser is configured such that the storage chamber cover 2 may be hingedly opened to add new chewing gum, e.g., when the chewing gum in the storage chamber 1 has been taken out completely. Thus, the apparatus is rationally designed, structurally simple, and convenient to use.

What is claimed is:

1. A dispensing container, comprising:

a housing having a first side, a second side, and a storage chamber formed therebetween, the housing further including a cover;

a holder configured to reciprocate between a stored position located within the housing and a dispensing position located external to the housing to dispense contents of the storage chamber;

a funnel apparatus proximate the holder, wherein the container is configured such that the contents pass through the funnel apparatus and into the holder;

a baffle movable with the holder, the baffle configured to prevent the contents of the container from falling into a gap formed when the holder moves to the dispensing position; and a plate adjacent to the funnel apparatus, the plate extending between the first side and the second side, wherein the funnel apparatus comprises a plurality of transverse or obliquely vertical or slope bodies arranged on the first side of the housing, wherein edges of the plurality of bodies form a gradually narrowing space from the storage chamber to the holder, and wherein the baffle is configured to nest with the plate when the holder is in the stored position.

2. The dispensing container of claim 1, wherein the cover is hingedly coupled to a remainder of the housing.

3. The dispensing container of claim 2, wherein the funnel apparatus is arranged on at least one of the first side and the second side.

4. The dispensing container of claim 2, wherein the funnel apparatus further comprises a second plurality of transverse or obliquely vertical or slope bodies arranged on the second side of the housing, wherein edges of the second plurality of bodies further combine with the edges of the plurality of bodies to form the gradually narrowing space from the storage chamber to the holder.

5. The dispensing container of claim 2, wherein the plurality of bodies increase in thickness along their lengths.

6. The dispensing container of claim 5, wherein the funnel apparatus is disposed above and transversely in-line with the holder.

7. The dispensing container of claim 2, wherein the container is configured such that the contents slide along the plate prior to passing through the funnel apparatus.

8. The dispensing container of claim 2, further comprising a handle configured to translate along a groove to effectuate reciprocation of the holder, the groove extending completely through one of the first side and the second side.

9. The dispensing container of claim 2, wherein the housing has a width extending between the first side and the second side that is smaller than a length or a height of the housing, such that the edges of the plurality of bodies gradually narrow the width of the funnel apparatus.

10. The dispensing container of claim 1, wherein the holder and the baffle are both configured to move forward at a same distance from the stored position to the dispensing position, and the holder and the baffle are both configured to move backward at the same distance from the dispensing position to the stored position.

11. A dispensing container, comprising:

a housing having a first side and a second side, wherein a first region of the dispensing container and a second region of the dispensing container are defined by and span an area between the first side and the second side, the first region comprising a storage chamber and the second region comprising a carrying holder, and a carrying groove baffle when the carrying holder is in a stored position;

a funnel apparatus comprising a plurality of transverse or obliquely vertical or slope bodies are arranged on the first side of the housing, wherein edges of the plurality of bodies form a narrowing space from the storage chamber to the carrying holder, such that contents of the storage chamber pass through the funnel apparatus and into the carrying holder, wherein the carrying holder is configured to reciprocate between the stored position located within the housing and a dispensing position located external to the housing to dispense contents of the storage chamber, the carrying holder including a plurality of sidewalls and a base extending therebetween, wherein the carrying groove baffle is configured to prevent the contents of the dispensing container from falling into the second region of the container when the carrying holder moves to the dispensing position, wherein a plate extends between the first side and the second side of the container adjacent to the funnel apparatus, wherein the plate and the funnel apparatus together are situated between and define a boundary between the first region and the second region, and wherein the carrying groove baffle of the carrying holder has a sloped shape configured to correspond with a sloped shape of the plate such that the carrying groove baffle is positioned beneath the plate when the carrying holder is in the stored position.

12. The dispensing container of claim 11, wherein the plate extends perpendicular to the first side and the second side.

13. The dispensing container of claim 11, wherein the baffle is movable with the carrying holder such that the baffle is configured to reciprocate at a same distance as the carrying holder between the stored position and the dispensing position.

14. A dispensing container, comprising:

a housing having a first side and a second side, wherein a first region of the dispensing container and a second region of the dispensing container are defined by and span an area between the first side and the second side, the first region comprising a storage chamber and the second region comprising a carrying holder, and a carrying groove baffle when the carrying holder is in a stored position;

a funnel apparatus comprising a plurality of transverse or obliquely vertical or slope bodies are arranged on the first side of the housing, wherein edges of the plurality of bodies form a narrowing space from the storage chamber to the carrying holder, such that contents of the storage chamber pass through the funnel apparatus and into the carrying holder;

a guide rail disposed on one of a plurality of sidewalls; and a guide rail groove disposed on the housing, wherein the carrying holder is configured to reciprocate between the stored position located within the housing and a dispensing position located external to the housing to dispense contents of the storage chamber, the carrying holder including the plurality of sidewalls and a base extending therebetween, wherein the carrying groove baffle is configured to prevent the contents of the dispensing container from falling into the second region of the container when the carrying holder moves to the dispensing position, and wherein the guide rail is configured to slide along the guide rail groove when the carrying holder moves between the stored position and the dispensing position.

15. The dispensing container of claim 14, further comprising:

a spring having a first end and a second end, wherein the first end is coupled to the housing and the second end is coupled to the carrying holder, and wherein the spring is configured to cause the carrying holder to return automatically from the dispensing position to the stored position.

16. The dispensing container of claim 14, wherein the funnel apparatus further comprises a second plurality of transverse or obliquely vertical or slope bodies arranged on the second side of the housing, wherein edges of the second plurality of bodies further combine with the edges of the plurality of bodies to form the narrowing space from the storage chamber to the carrying holder.

17. The dispensing container of claim 14, wherein the housing has a width extending between the first side and the second side that is smaller than a length or a height of the housing, such that the edges of the plurality of bodies gradually narrow the width of the funnel apparatus.

18. A dispensing container, comprising:

a housing having a first side and a second side opposite the first side, with a storage chamber formed therebetween and configured for holding contents, the housing having a width defined between the first and second sides, a length perpendicular to the width and defined in a longitudinal direction, and a height defined perpendicular to the width and the length, wherein the width of the housing is smaller than the length and the height;

a holder having a cavity configured to receive and dispense the contents of the storage chamber, the holder being configured to move along the longitudinal direction between a stored position, wherein the cavity is open to the storage chamber to receive the contents, a dispensing position, wherein a portion of the holder extends external to the housing, and the cavity is open at a location external to the housing to dispense the contents;

a funnel apparatus connected to the housing and extending into the storage chamber to define a funnel space within the storage chamber and adjacent to the cavity when the holder is in the stored position, the funnel apparatus being positioned and configured such that the contents pass through the funnel space and into the cavity of the holder when the holder is in the stored position, wherein the funnel apparatus gradually narrows the width of the funnel space as the funnel apparatus approaches the cavity;

a plate extending between the first side and the second side of the housing adjacent to the funnel apparatus, the plate and the housing defining a passage, wherein the cavity of the holder is open within the passage when the holder is in the stored position; and a baffle movable with the holder, the baffle configured to prevent the contents from falling from the storage chamber into the passage when the holder is in the dispensing position, wherein the baffle and the plate are dimensioned such that the baffle nests with an underside of the plate when the holder is in the stored position.

19. The dispensing container of claim 18, wherein the funnel apparatus comprises a first body extending inward from the first side of the housing, wherein the first body is configured to gradually narrow the width of the funnel space as the funnel apparatus approaches the cavity.

20. The dispensing container of claim 19, wherein the funnel apparatus further comprises a second body extending inward from the second side of the housing, wherein the first body and the second body are configured to gradually narrow the width of the funnel space as the funnel apparatus approaches the cavity.

21. The dispensing container of claim 18, wherein the funnel apparatus comprises a plurality of transverse or obliquely vertical or slope bodies arranged on the first side of the housing, wherein edges of the plurality of bodies are configured to gradually narrow the width of the funnel space as the funnel apparatus approaches the cavity.

22. The dispensing container of claim 18, wherein the funnel apparatus comprises a plurality of transverse or obliquely vertical or slope bodies arranged on both of the first and second sides of the housing, wherein edges of the plurality of bodies are configured to gradually narrow the width of the funnel space as the funnel apparatus approaches the cavity.

23. The dispensing container of claim 18, the housing further including a cover that is configured to be opened and closed to fill the contents into the storage chamber.

24. The dispensing container of claim 18, wherein the baffle is movable with the holder such that the baffle is configured to move along the longitudinal direction at a same distance as the holder between the stored position and the dispensing position.

* * * * *